US005318694A

United States Patent [19]

Maher et al.

[11] Patent Number: 5,318,694

[45] Date of Patent: * Jun. 7, 1994

[54] FCC FOR PRODUCING LOW EMISSION FUELS FROM HIGH HYDROGEN AND LOW NITROGEN AND AROMATIC FEEDS

[75] Inventors: Patrick J. Maher, Baton Rouge; William L. Schuette, New Roads; William E. Winter, Baton Rouge, all of La.

[73] Assignee: Exxon Research and Engineering Company, Florham Park, N.J.

[ * ] Notice: The portion of the term of this patent subsequent to May 24, 2011 has been disclaimed.

[21] Appl. No.: 982,932

[22] Filed: Nov. 30, 1992

[51] Int. Cl.[5] ..... C10G 11/05; C10G 11/18

[52] U.S. Cl. ..... 208/120; 208/61; 208/89; 208/113

[58] Field of Search ..... 208/120, 89, 61, 113

[56] References Cited

U.S. PATENT DOCUMENTS 4,260,475 4/1981 Scott ..... 208/113

*Primary Examiner*—R. Bruce Breneman
*Assistant Examiner*—Lorna M. Douyon
*Attorney, Agent, or Firm*—Henry E. Naylor

[57] ABSTRACT

A fluid catalytic cracking process for producing relatively low emissions fuels. The feedstock is exceptionally low in nitrogen and aromatics and relatively high in hydrogen and a 345° C.+ products fraction is recycled to the cracking zone. The catalyst is an amorphous silica-alumina or a zeolitic material which is iso-structural to faujasite. The feedstock can be characterized as having less than about 50 wppm nitrogen; greater than about 13 wt. % hydrogen; less than about 7.5 wt. % 2+ ring aromatic cores; and not more than about 15 wt. % aromatic cores overall.

7 Claims, No Drawings

FCC FOR PRODUCING LOW EMISSION FUELS FROM HIGH HYDROGEN AND LOW NITROGEN AND AROMATIC FEEDS

FIELD OF THE INVENTION

The present invention relates to a fluid catalytic cracking process for producing lower boiling products, including low emissions fuels. The feedstock is exceptionally low in nitrogen and aromatics and relatively high in hydrogen. A 345° C.+ product fraction is recycled to the reaction zone. The catalyst is an amorphous silica-alumina or a zeolitic material .The feedstock can be characterized as having less than about 50 wppm nitrogen; greater than about 13 wt. % hydrogen; less than about 7.5 wt. % 2+ ring aromatic cores; and not more than about 15 wt. % aromatic cores overall.

BACKGROUND OF THE INVENTION

Catalytic cracking is an established and widely used process in the petroleum refining industry for converting petroleum oils of relatively high boiling point to more valuable lower boiling products, including gasoline and middle distillates, such as kerosene, jet fuel and heating oil. The preeminent catalytic cracking process now in use is the fluid catalytic cracking process (FCC) in which a preheated feed is brought into contact with a hot cracking catalyst which is in the form of a fine powder, typically having a particle size of about 10–300 microns, usually about 100 microns, for the desired cracking reactions to take place. During the cracking, coke and hydrocarbonaceous material are deposited on the catalyst particles. This results in a loss of catalyst activity and selectivity. The coked catalyst particles, and associated hydrocarbon material, are subjected to a stripping process, usually with steam, to remove as much of the hydrocarbon material as technically and economically feasible. The stripped particles containing non-strippable coke, are removed from the stripper and sent to a regenerator where the coked catalyst particles are regenerated by being contacted with air, or a mixture of air and oxygen, at elevated temperature. This results in the combustion of the coke which is a strongly exothermic reaction which, besides removing the coke, serves to heat the catalyst to the temperatures appropriate for the endothermic cracking reaction. The process is carried out in an integrated unit comprising the cracking reactor, the stripper, the regenerator, and the appropriate ancillary equipment. The catalyst is continuously circulated from the reactor or reaction zone, to the stripper and then to the regenerator and back to the reactor. The circulation rate is typically adjusted relative to the feed rate of the oil to maintain a heat balanced operation in which the heat produced in the regenerator is sufficient for maintaining the cracking reaction with the circulating regenerated catalyst being used as the heat transfer medium. Typical fluid catalytic cracking processes are described in the monograph Fluid Catalytic Cracking with Zeolite Catalysts, Venuto, P. B. and Habib, E. T., Marcel Dekker Inc. N.Y. 1979, which is incorporated herein by reference. As described in this monograph, catalysts which are conventionally used are based on zeolites, especially the large pore synthetic faujasites, zeolites X and Y.

Typical feeds to a catalytic cracker can generally be characterized as being a relatively high boiling oil or residuum, either on its own, or mixed with other fractions, also usually of a relatively high boiling point. The most common feeds are gas oils, that is, high boiling, non-residual oils, with an initial boiling point usually above about 230° C., more commonly above about 350° C., with end points of up to about 620° C. Typical gas oils include straight run (atmospheric) gas oil, vacuum gas oil, and coker gas oils.

While such conventional fluid catalytic cracking processes are suitable for producing conventional transportation fuels, such fuels are generally unable to meet the more demanding requirements of low emissions fuels. To meet low emissions standards, the fuel products must be relatively low in sulfur, nitrogen, and aromatics, especially multiring aromatics. Conventional fluid catalytic cracking is unable to meet such standards. These standards will require either further changes in the FCC process, catalysts, or post-treating of all FCC products. Since post-treating to remove aromatics from gasoline or distillate fuels is particularly expensive, there are large incentives to limit the production of aromatics in the FCC process. Consequently, there exists a need in the art for methods of producing large quantities of low emissions transportation fuels, such as gasoline and distillates.

SUMMARY OF THE INVENTION

In accordance with the present invention, there is provided a fluid catalytic cracking process for producing low emissions fuel products, which process comprises:

(a) introducing a hydrocarbonaceous feedstock into a reaction zone of a catalytic cracking unit comprised of a reaction zone and a regeneration zone, which feedstock is characterized as having: an initial boiling point from about 230° C. to about 350° C., with end points up to about 620° C.; a nitrogen content less than about 50 wppm; a hydrogen content in excess of about 13 wt. %; a 2+ ring aromatic core content of less than about 7.5 wt. %; and an overall aromatic core content of less than about 15 wt. %;

(b) catalytically cracking said feedstock in said reaction zone at a temperature from about 450° C. to about 600° C., by causing the feedstock to be in contact with a cracking catalyst for a contact time of about 0.5 to 5 seconds, which cracking catalyst is selected from the group consisting of: (a) an amorphous acidic catalytic material; and (b) a zeolitic material; thereby producing lower boiling products and spent catalyst particles which contain coke and hydrocarbonaceous material;

(c) separating a 345° C.+ fraction from said lower boiling products;

(d) recycling said 345° C.+ fraction to said reaction zone;

(e) stripping said spent catalyst particles with a stripping medium in a stripping zone to remove therefrom at least a portion of said hydrocarbonaceous material;

(f) recovering said stripped hydrocarbonaceous material from the stripping zone;

(g) regenerating said coked catalyst in a regeneration zone by burning-off a substantial amount of the coke on said catalyst, and optionally an added fuel component, to maintain the regenerated catalyst at a temperature which will maintain the catalytic cracking reactor at a temperature from about 450° C. to about 600° C.; and (h) recycling said regenerated catalyst to the reaction zone.

In preferred embodiments of the present invention, an added fuel component is used in the regeneration zone and is selected from: $C_2-$ light gases from the catalytic cracking unit, natural gas, and any other non-residual petroleum refinery stream in the appropriate boiling range.

In preferred embodiments of the present invention the catalyst is an amorphous silica-alumina having about 10 to 40 wt. % alumina or a zeolitic material having a unit cell size less than about 24.25 Å.

In other preferred embodiments of the present invention the contact time is about 0.5 to 3 seconds.

DETAILED DESCRIPTION OF THE INVENTION

The practice of the present invention results in the production of less aromatic naphtha products as well as the production of more $C_3$ and $C_4$ olefins which can be converted to high octane, non-aromatic gasoline components, such as methyl tertiary butyl ether or alkylates.

Feedstocks which are suitable for being converted in accordance with the present invention are any of those hydrocarbonaceous feedstocks which are in the boiling point range of conventional feedstocks for fluid catalytic cracking. Such streams typically have an initial boiling point of about 230° C. to about 350° C., with an end point up to about 620° C. The feedstocks of the present invention must also contain no more than about 50 wppm nitrogen, no more than about 7.5 wt. % 2+ ring aromatic cores, no more than about 15 wt. % aromatic cores overall, and at least about 13 wt. % hydrogen. Non-limiting examples of such feeds include the non-residual petroleum based oils such as straight run (atmospheric) gas oil, vacuum gas oil, and coker gas oil. Other oils may also be used, such as those from synthetic sources which are normally liquid or solid, such as coal and oil-shale, and which may be catalytically cracked, either on their own or in admixture with oils of petroleum origin. Such oils from synthetic sources will typically be comprised of a mixture of aromatics, paraffins, and cyclic paraffins. Feedstocks which are suitable for use in the practice of the present invention may not be readily available in a refinery. This is because typical refinery streams in the boiling point range of interest, and which are conventionally used for fluid catalytic cracking, generally contain too high a content of undesirable components such as nitrogen, sulfur, and aromatics. Consequently, such streams will need to be upgraded, or treated, to lower the level of such undesirable components. Non-limiting methods for upgrading such streams include hydrotreating in the presence of hydrogen and a supported Mo containing catalyst with Ni and/or Co; extraction methods, including solvent extraction as well as the use of solid absorbents, such as various molecular sieves. It is preferred to hydrotreat the streams.

Any suitable conventional hydrotreating process can be used as long as it results in a stream having the characteristics of nitrogen, sulfur, and aromatics level as previously mentioned. That is nitrogen levels of less than about 50 wppm, preferably less than about 30 wppm, more preferably less than about 15 wppm, and most preferably less than about 5 wppm; a hydrogen content of greater than about 13 wt. %, preferably greater than about 13.5 wt. %; a 2+ ring aromatic core content of less than about 7.5 wt. %, preferably less than about 4 wt. %; and an overall aromatic core content of less than about 15 wt. %, preferably less than about 8 wt. %.

Suitable hydrotreating catalysts are those which are typically comprised of a Group VIB (according to the Sargent-Welch Scientific Company Periodic Table of the Elements) metal with one or more Group VIII metals as promoters, on a refractory support. It is preferred that the Group VIB metal be molybdenum or tungsten, more preferably molybdenum. Nickel and cobalt are the preferred Group VIII metals with alumina being the preferred support. The Group VIII metal is present in an amount ranging from about 2 to 20 wt. %, expressed as the metal oxides, preferably from about 4 to 12 wt. %. The Group VIB metal is present in an amount ranging from about 5 to 50 wt. %, preferably from about 10 to 40 wt. %, and more preferably from about 20 to 30 wt. %. All metals weight percents are based on the total weight of the catalyst. Supports suitable for such catalysts are typically inorganic oxides, such as alumina, silica, silica-alumina, titania, and the like. Preferred is alumina.

Suitable hydrotreating conditions include temperatures ranging from about 250° to 450° C., preferably from about 350° C. to 400° C.; pressures from about 250 to 3000 psig; preferably from about 1500 to 2500 psig; hourly space velocities from about 0.05 to 6 V/V/Hr; and a hydrogen gas rate of about 500 to 10000 SCF/B; where SCF/B means standard cubic feet per barrel, and V/V/HR means volume of feed per volume of catalyst per hour.

A hydrocarbonaceous feedstock which meets the aforementioned requirements for producing a low emissions fuel is fed to a conventional fluid catalytic cracking unit. The catalytic cracking process may be carried out in a fixed bed, moving bed, ebullated bed, slurry, transfer line (dispersed phase), riser or dense bed fluidized bed operation. It is preferred that the catalytic cracking unit be a fluid catalytic cracking (FCC) unit. Such a unit will typically contain a reactor where the hydrocarbonaceous feedstock is brought into contact with hot powdered catalyst particles which were heated in a regenerator. Transfer lines connect the two vessels for moving catalyst particles back and forth. The cracking reaction will preferably be carried out at a temperature from about 450° to about 680° C., more preferably from about 480° to about 560° C.; pressures from about 5 to 60 psig, more preferably from about 5 to 40 psig; contact times (catalyst in contact with feed) of about 0.5 to 15 seconds, more preferably about I to 6 seconds; and a catalyst to oil ratio of about 0.5 to 10, more preferably from about 2 to 8. During the cracking reaction, lower boiling products are formed and some hydrocarbonaceous material, and non-volatile coke are deposited on the catalyst particles. The lower boiling products are fractionated into various boiling point fractions, inclusive of a 345° C.+ fraction. That is, a fraction having an initial boiling point of 345° C. or greater. This 345° C.+ fraction is recycled to the reaction zone. This leads to fuel product streams with even lower levels of aromatics. The hydrocarbonaceous material is removed by stripping, preferably with steam. The non-volatile coke is typically comprised of highly condensed aromatic hydrocarbons which generally contain about 4 to 10 wt. % hydrogen. As hydrocarbonaceous material and coke build up on the catalyst, the activity of the catalyst for cracking, and the selectivity of the catalyst for producing gasoline blending stock, is diminished. The catalyst particles can recover a major proportion of their original capabilities by removal of most of the hydrocarbonaceous material by stripping and the coke by a suitable oxidative regeneration process. Consequently, the catalyst particles are sent to a stripper and then to a regenerator.

Catalyst regeneration is accomplished by burning the coke deposits from the catalyst surface with an oxygen-containing gas, such as air. Catalyst temperatures during regeneration may range from about 560° C. to about 760° C. The regenerated, hot catalyst particles are then transferred back to the reactor via a transfer line and, because of their heat, are able to maintain the reactor at the temperature necessary for the cracking reactions. Coke burn-off is an exothermic reaction, therefore in a conventional fluid catalytic cracking unit with conventional feeds, no additional fuel needs to be added. The feedstocks used in the practice of the present invention, primarily because of their low levels of aromatics, and also due to the relatively short contact times in the reactor or transfer line, may not deposit enough coke on the catalyst particles to achieve the necessary temperatures in the regenerator. Therefore, it may be necessary to use an additional fuel to provide increased temperatures in the regenerator so the catalyst particles returning to the reactor are hot enough to maintain the cracking reactions. Non-limiting examples of suitable additional fuel include $C_2^-$ gases from the catalytic cracking process itself, natural gas, and any other non-residual petroleum refinery stream in the appropriate boiling range. Such additional fuels are sometimes referred to as torch oils. Preferred are the $C_2^-$ gases.

Catalysts suitable for use in the present invention are selected from: (a) amorphous solid acids, such as alumina, silica-alumina, silica-magnesia, silica-zirconia, silica-thoria, silica-beryllia, silica-titania, and the like; and (b) zeolite catalysts containing faujasite. Silica-alumina materials suitable for use in the present invention are amorphous materials containing about 10 to 40 wt. % alumina and to which other promoters may or may not be added.

Zeolitic materials suitable for use in the practice of the present invention are zeolites which are iso-structural to zeolite Y. These include the ion-exchanged forms such as the rare-earth hydrogen and ultra stable (USY) form. The particle size of the zeolite may range from about 0.1 to 10 microns, preferably from about 0.3 to 3 microns. The zeolite will be mixed with a suitable porous matrix material when used as a catalyst for fluid catalytic cracking. Non-limiting porous matrix materials which may be used in the practice of the present invention include alumina, silica-alumina, silica-magnesia, silica-zirconia, silica-thoria, silica-beryllia, silica-titania, as well as ternary compositions, such as silica-alumina-thoria, silica-alumina-zirconia, magnesia and silica-magnesia-zirconia. The matrix may also be in the form of a cogel . The relative proportions of zeolite component and inorganic oxide gel matrix on an anhydrous basis may vary widely with the zeolite content, ranging from about 10 to 99, more usually from about 10 to 80, percent by weight of the dry composite. The matrix itself may possess catalytic properties, generally of an acidic nature.

Suitable amounts of zeolite component in the total catalyst will generally range from about 1 to about 60 wt. %, preferably from about 1 to about 40 wt. %, and more preferably from about 5 to about 40 wt. %, based on the total weight of the catalyst. Generally, the particle size of the total catalyst will range from about 10 to 300 microns in diameter, with an average particle diameter of about 60 microns. The surface area of the matrix material will be about $\leqq 350$ $m^2/g$, preferably 50 to 200 $m^2/g$, more preferably from about 50 to 100 $m^2/g$. While the surface area of the final catalysts will be dependent on such things as type and amount of zeolite material used, it will usually be less than about 500 $m^2/g$, preferably from about 50 to 300 $m^2/g$, more preferably from about 50 to 250 $m^2/g$, and most preferably from about 100 to 250 $m^2/g$.

The following examples are presented for illustrative purposes and are not be taken as limiting the present invention in any way.

EXAMPLE 1 (COMPARATIVE)

Cracking tests were conducted in a pressurized transfer line fluid catalytic cracking pilot plant. These tests were conducted in a "once-through" method and do not represent a process of the present invention. In these pilot plant tests, hot, regenerated cracking catalyst was fed from a hopper via a screw feeder into a riser where it was contacted with preheated oil and a nitrogen diluent. The oil was vaporized at this point and the catalyst-/oil mixture flowed upwards through a 39 ft transfer line where the oil was cracked to lower boiling products, and coke. At the reactor outlet, the catalyst and vapor products were separated. The Catalyst was dropped into a catalyst stripper while vapor products passed into a chilled product recovery section. Condensed liquids were collected in a product accumulator while product gases were metered and sampled. These tests were run at the conditions listed below:

| | |
|---|---|
| Temperature, °C. | 495 |
| Catalyst/Oil Ratio | 4 to 7 |
| Catalyst/Oil Contact Time, Sec. | 1 to 4 |
| Reactor Pressure, Psig | 20–45 |
| Feed Rate, gm/hr | 80 |

The catalyst used in these tests was an equilibrium catalyst available under the tradename Octacat-D from Davison and was obtained from a commercial fluid catalytic cracking unit. This catalyst contained a relatively low unit cell size USY zeolite in an alumina sol binder. This catalyst is designated as catalyst ZA. Properties of Catalyst ZA are listed below.

| Catalyst | ZA |
|---|---|
| $Al_2O_3$ | 43.6 wt. % |
| $SiO_2$ | 54.1 |
| $Re_2O_3$ | 1.3 |
| $Na_2O$ | 0.4 |
| Ni | 180 wppm |
| V | 480 |
| Surface Area, $M^2/g$ | 146 |
| P.V., cc/g | 0.21 |
| Unit Cell, Å | 24.24 |

Two conventional fluid catalytic cracking feeds were used for these experiments. The first, designated "RA" was an aromatics extract from a commercial lubes processing operation. The second, designated "RB" was a conventional vacuum gas oil. Feed properties are given below.

| | Feedstock Properties | |
|---|---|---|
| Feedstock | RA | RB |
| Wppm Nitrogen | 2503 | 1430 |

-continued

| Feedstock | Feedstock Properties RA | RB |
|---|---|---|
| Wt % Sulfur | 2.6 | 1.6 |
| Wt % Carbon | 85.6 | 85.8 |
| Wt % Hydrogen | 10.4 | 12.1 |
| Gravity, °API | 13.8 | 21.2 |
| % Saturates | 25 | 47 |
| % 1R - Aromatic | 20 | 19 |
| % Total Arom Cores | 27 | 16 |
| % 2 + Ring Arom Cores | 23 | 13 |

The total liquid product from these pilot plant tests was fractionated into 15/220° C., 220/345° C. (light catalytic cycle oil, LCCO), and 345° C.+ (bottoms, BTMS) cuts, or fractions. These fractions were then analyzed using various techniques, including mass spectrometry (MS) and gas chromatography (GC), for elemental compositions, gravity, and hydrocarbon compound types.

Detailed catalytic cracking data are given below for tests made with the two conventional feeds and Catalyst ZA. Conversions, yields, and products qualities are shown at a coke yield of 5 wt. %, which is a typical coke yield for a commercial, heat-balanced fluid catalytic cracking process.

| Once-Through Cracking of Conventional FCC Feeds | | |
|---|---|---|
| Feed | RA | RB |
| Cat/Oil Ratio | 4.2 | 6.5 |
| Conversion, 220° C. | 37 | 56 |
| Yields, Wt % | | |
| Coke | 5.0 | 5.0 |
| $C_2^-$ Dry Gas | 2.0 | 1.7 |
| $C_3H_6$ | 1.4 | 2.0 |
| $C_3H_8$ | 0.7 | 0.7 |
| $C_4H_8$ | 2.2 | 4.0 |
| $C_4H_{10}$ | 0.7 | 1.6 |
| 15/220° C. Naphtha | 25 | 41 |
| 220/345° C. LCCO | 15 | 18 |
| 345° C.+ Bottoms | 48 | 26 |
| 15°-220° C. Naphtha Composition wt. % | | |
| Aromatics | 23 | 15 |
| Olefins | 59 | 60 |
| Saturates | 18 | 25 |
| LCCO Properties | | |
| Gravity, °API | 20 | 24 |
| Cetane Number | 20 | 23 |
| Bottoms Properties | | |
| Gravity, °API | 9 | 13 |

With a coke yield of 5 wt %, only 37 wt % of the feed RA was converted to naphtha and lighter products. At the same time, 56 wt % of the conventional VGO RB feed was converted. At these relatively low conversions, naphtha aromatics levels remained relatively low. However, aromatic levels of the LCCO products were relatively high as evidenced by low API gravities and cetane ratings. It is noted that the cetane rating of the LCCO produced from the VGO feed RB was not much higher than the cetane rating of the LCCO produced from the highly aromatic feed RB. It is also noted that the API gravity of the bottoms products are substantially lower than the respective gravities of the RA and RB feeds. These low LCCO and bottoms gravities are believed to result from at least two factors. The first factor is aromatics concentration in the LCCO and bottoms product fractions as sidechains are cracked from 2+ ring aromatic compounds. A second factor is the formation of aromatic compounds via hydrogen transfer reactions.

These data show that conventional fluid catalytic cracking of conventional feeds is not particularly suitable for producing low emissions fuels. Although naphtha aromatics can be maintained at relatively low levels at low conversions, high yields of highly aromatic LCCO and bottoms products are produced at the same time. Aromatic, low cetane LCCO are not suited for blending into low emissions diesel fuel. The aromatic bottoms are particularly undesirable, low value products.

EXAMPLE 2 (COMPARATIVE)

Further cracking tests were conducted in the same pilot plant, at the same conditions, and with the same catalysts which are described in Example 1 above. Two clean fluid catalytic cracking feeds, containing more than 13 wt % hydrogen and about 50 wppm or less of nitrogen were used for these tests. One clean feed was a naphthenic dewaxed oil and is designated feed CN. The other was a paraffinic slack wax and is designated feed CP. Feed properties are given below.

| Feedstock | Feedstock Properties CN | CP |
|---|---|---|
| Wppm Nitrogen | 53 | 6 |
| Wt % Sulfur | 0.2 | 0.1 |
| Wt % Carbon | 86.4 | 85.7 |
| Wt % Hydrogen | 13.5 | 13.9 |
| Gravity, °API | 29.8 | 34.2 |
| % Saturates | 79 | 83 |
| % 1R - Aromatic | 18 | 13 |
| % Total Arom Cores | 3 | 2 |
| % 2 + Ring Arom Cores | 1 | 1 |

Detailed cracking data are given below for tests made with the clean feeds and Catalyst ZA. Results shown for the clean feeds were obtained at comparable catalyst-to-oil ratios to those used with the conventional feed, RB. As expected, this provided much higher conversions than those obtained with the conventional fluid catalytic cracking feeds. Even so, coke yields obtained with these clean feeds were low and would not limit conversion to lighter products. Heat balance for these feeds can be obtained by burning a portion of light gaseous products or torch oil.

| Once-Through Cracking of Conventional and Clean FCC Feeds | | |
|---|---|---|
| Feed | CN | CP |
| Catalyst/Oil Ratio | 6.4 | 6.0 |
| Conversion, 220° C. | 83 | 83 |
| Yields, Wt % | | |
| Coke | 1.7 | 1.5 |
| $C_2^-$ Dry Gas | 1.3 | 1.3 |
| $C_3H_6$ | 3.7 | 4.4 |
| $C_3H_8$ | 0.7 | 0.8 |
| $C_4H_8$ | 7.0 | 8.2 |
| $C_4H_{10}$ | 4.2 | 4.2 |
| 15/220° C. Naphtha | 63 | 65 |
| 220/345°C. LCCO | 13 | 12 |
| 345°C. + Bottoms | 4 | 5 |
| 15/220°C. Naphtha Composition. wt. % | | |
| Aromatics | 18 | 15 |
| Olefins | 41 | 39 |
| Saturates | 41 | 46 |
| LCCO Properties | | |
| Gravity, °API | 26 | 30 |
| Cetane Number | 25 | 32 |
| Bottoms Properties | | |

-continued

| Once-Through Cracking of Conventional and Clean FCC Feeds | | |
|---|---|---|
| Feed | CN | CP |
| Gravity, °API | 14 | 16 |

Although the clean FCC feeds used in these tests contained very low levels of aromatic compounds, naphtha, distillate, and bottoms products were nearly as aromatic as products from a conventional feed. Conversions were higher, but lower feed aromatics did not substantially reduce naphtha aromatics. LCCO cetane ratings and bottoms gravities were also increased over conventional feed cracking, but those differences were smaller than differences in feed properties. This suggests aromatization reactions were an important factor in these tests. As a result, one cannot simultaneously reduce naphtha aromatics, boost LCCO cetane numbers, and boost conversion by cracking clean feeds at high "once-through" conditions.

EXAMPLE 3

Further cracking tests were conducted in the same pressurized transfer line cat cracking pilot plant and with the same catalyst described in Example 1. These tests were made with the clean FCC feeds described in Example 2. Test conditions were similar to those employed in Example 2, but at a lower cat to oil ratio. In addition, 345° C.+ FCC products were recycled to the cracking operation. Conversion "per pass" or conversion on a total feed basis were lower than those obtained at the higher cat to oil ratio. Overall conversion to 220° C.− products on a fresh feed basis was equivalent to the conversion obtained at the higher cat to oil ratio.

Detailed cracking data are given below for these clean feed FCC recycle tests. As was the case in Example 2, coke yields were very low and would not limit conversion in a commercial, heat-balanced process. A supplemental fuel, such as the $C_2^-$ Dry Gas product, could be used to provide the heat required to crack these feeds.

| Recycle Cracking of Clean FCC Feeds | | |
|---|---|---|
| Feed | CN | CP |
| Cat/Oil Ratio | 4.1 | 3.8 |
| Recycle/FF Ratio | 0.2 | 0.19 |
| Conversion, 220° C. | 83 | 84 |
| Yields, Wt % | | |
| Coke | 0.9 | 0.9 |
| $C_2^-$ Dry Gas | 1.6 | 1.4 |
| $C_3H_6$ | 3.7 | 4.0 |
| $C_3H_8$ | 0.5 | 0.6 |
| $C_4H_8$ | 7.5 | 8.9 |
| $C_4H_{10}$ | 2.9 | 3.2 |
| 15/220° C. Naphtha | 66.2 | 65.5 |
| 220/345° C. LCCO | 16.7 | 15.5 |
| 345° C. + Bottoms | 0 | 0 |
| 15/220° C. Naphtha Composition wt. % | | |
| Aromatics | 13 | 9 |
| Olefins | 58 | 62 |
| Saturates | 29 | 29 |
| LCCO Properties | | |
| Gravity, °API | 31 | 36 |
| Cetane Number | 28 | 32 |
| Bottoms Properties | | |
| Gravity, °API | n/a | n/a |

Comparing these results to the results disclosed in Examples 1 and 2, it is seen that practice of the present invention produces cat naphthas containing lower concentrations of aromatic compounds than higher severity once through cracking of clean feeds. Lower severity, recycle cracking also produced LCCO products with higher API gravities and, for feed CN, higher cetane numbers. There was no net production of bottoms product. Bottoms products could be recycled to extinction, because aromatics were not produced from the clean feed or concentrated in the recycle stream at the lower conversion per pass employed in these tests.

EXAMPLE 4 (COMPARATIVE)

Further cracking tests were conducted in the same pressurized transfer line fluid catalytic cracking pilot unit and the same feeds as set forth in Example 1 above. Test conditions were similar to those employed in Example 2, but at a lower catalyst to oil ratio. In addition, 345° C.+ fluid catalytic cracked products were recycled to the cracking zone. Conversion "per pass", or conversion on a total feed basis, were lower than those obtained at the higher catalyst to oil ratio.

Detailed cracking data are given below for this conventional feed fluid catalytic cracking recycle tests. As was the case in Example 1, conversions, yields, and products qualities are shown at a coke yield of 5 wt. %, which is a typical coke yield for a commercial, heat-balanced fluid catalytic cracking process. Note that limiting coke yields to 5 wt. % on feed limited the amount of 345° C.+ bottoms product which could be recycled.

| Recycle Cracking of Conventional FCC Feeds | |
|---|---|
| Feed | RB |
| Cat/Oil Ratio | 4.0 |
| Recycle/FF Ratio | 0.2 |
| Conversion, 220° C. | 53 |
| Yields, Wt % | |
| Coke | 5.0 |
| $C_2^-$ Dry Gas | 2.2 |
| $C_3H_6$ | 1.9 |
| $C_3H_8$ | 0.6 |
| $C_4H_8$ | 3.5 |
| $C_4H_{10}$ | 1.5 |
| 15/220° C. Naphtha | 38.2 |
| 220/345° C. LCCO | 19.0 |
| 345° C. + Bottoms | 28.1 |
| 15/220° C. Naphtha Composition, wt. % | |
| Aromatics | 16 |
| Olefins | 64 |
| Saturates | 20 |
| LCCO Properties | |
| Gravity, °API | 24 |
| Cetane Number | 22 |
| Bottoms Properties | |
| Gravity, °API | 14 |

Comparing these results to the results disclosed in Examples 1, it is seen that recycling 345° C.+ products from a conventional fluid catalytic cracking feed does not improve the quality of naphtha or distillate products. Naphtha aromatics content was not reduced nor did LCCO gravity or cetane number increase. Moreover, lower severity, recycle cracking of conventional feeds did not reduce 345° C.+ bottoms yield. In fact, conversion at a coke yield of 5 wt % was somewhat lower than for once through cracking of the same feed. These results are not completely understood. Nonetheless, it is believed that recycling the 345° C.+ products from conventional fluid catalytic cracker feeds not only concentrated aromatics in the recycle stream, but that additional aromatics compounds were produced from non-aromatic feed compounds at fluid catalytic cracking conditions. These aromatics tended to produce additional coke which limited conversion.

What is claimed is:

1. A fluid catalytic cracking process for producing low emission fuel products, which process comprises the steps of:

(a) introducing a hydrocarbonaceous feedstock into a reaction zone of a catalytic cracking unit comprised of a reaction zone, stripping zone, and a regeneration zone, which feedstock is characterized as having: an initial boiling point from about 230° C. to about 350° C., with end points up to about 620° C.; a nitrogen content less than about 50 wppm; a hydrogen content in excess of about 13 wt. %; a 2+ ring aromatic core content of less than about 7.5 wt. %; and an overall aromatic core content of less than about 15 wt. %;

(b) catalytically cracking said feedstock in said reaction zone at a temperature from about 450° C. to about 600° C., by causing the feedstock to be in contact with a cracking catalyst for a contact time of about 1 to 5 seconds, which cracking catalyst is selected from the group consisting of: (a) an amorphous acidic catalytic material having a surface area, after steaming at 760° C. for 16 hours, from about 75 to 200 $m^2/g$; and (b) a catalyst material containing a zeolite which is iso-structural to faujasite; thereby producing lower boiling products and spent catalysts particles which contain coke and hydrocarbonaceous material;

(c) separating a 345C+ fraction from said lower boiling products;

(d) recycling said 345C+ fraction to said reaction zone;

(e) stripping said spent catalyst particles with the stripping medium in a stripping zone to remove therefrom at least a portion of said hydrocarbonaceous material;

(f) recovering said stripped hydrocarbonaceous material from the stripping zone;

(g) regenerating said coked spent catalyst in a regeneration zone by burning-off a substantial amount of the coke on said spent catalyst, and optionally an added fuel component to maintain the regenerated catalyst at a temperature which will maintain the catalytic cracking reactor at a temperature from about 450° C. to about 600° C.; and (h) recycling said regenerated catalyst to the reaction zone.

2. The process of claim 1 wherein the catalyst is an amorphous silica-alumina material.

3. The process of claim 2 wherein the silica-alumina material contains from about 15 to 25 wt. % alumina.

4. The process of claim 1 wherein the catalyst is zeolitic material in an inorganic matrix, which zeolitic material is a Y type zeolite having a unit cell size of 24.25 Å or less.

5. The process of claim 4 wherein the hydrocarbonaceous feedstock contains: less than about 20 wppm nitrogen, greater than about 13.5 wt. % hydrogen, less than about 4 wt. % of 2+ring aromatic cores, and an overall aromatic core content of less than about 8 wt. %.

6. The process of claim 5 wherein the catalyst is an amorphous silica-alumina material containing from about 15 to 25 wt. % alumina.

7. The process of claim 5 wherein the catalyst is zeolitic material in an inorganic matrix, which zeolitic material is a Y type zeolite having a unit cell size of 24.25 Å or less.

* * * * *